US005155924A

United States Patent [19]

Smith

[11] Patent Number: 5,155,924

[45] Date of Patent: Oct. 20, 1992

[54] RECONFIGURABLE DRYER SYSTEM FOR WATER-DAMAGED FLOORS AND WALLS

[76] Inventor: Terry C. Smith, 16435 S.E. 34th St.,, Bellevue, Wash. 98008

[21] Appl. No.: 636,758

[22] Filed: Jan. 2, 1991

[51] Int. Cl.[5] ..... F26B 3/00

[52] U.S. Cl. ..... 34/22; 34/243 R; 34/86; 15/405; 15/DIG. 7; 392/379

[58] Field of Search ..... 34/237, 243 R, 22, 42, 34/34, 86, 35, 90, 91; 15/300 R, 405, 406, 414, 49.1, DIG. 7, 334–338; 392/379

[56] References Cited

U.S. PATENT DOCUMENTS

| | | | |
|---|---|---|---|
| 1,016,435 | 2/1912 | Overholt | 34/243 R |
| 1,661,553 | 3/1928 | Baar | 34/243 R |
| 1,703,551 | 2/1929 | Singer | 34/243 R |
| 3,115,567 | 12/1963 | Meltzer | 34/243 R |
| 3,805,405 | 4/1974 | Ambos | 34/104 |
| 4,571,849 | 2/1986 | Gardner et al. | 34/243 R |

FOREIGN PATENT DOCUMENTS

| | | | |
|---|---|---|---|
| 195402 | 2/1908 | Fed. Rep. of Germany | 34/243 |
| 546486 | 2/1932 | Fed. Rep. of Germany | 34/243 |
| 564420 | 12/1923 | France | 34/243 |
| 643073 | 2/1928 | France | 34/243 |

*Primary Examiner*—Henry A. Bennet
*Assistant Examiner*—Denise L. F. Gromada

[57] ABSTRACT

This dryer system for concentrated drying of water-damaged building surfaces in typical residential and commercial constructions is temporarily attached during the drying process and is removed after the damaged area is dried. The dryer system comprises a high-volume, forced air blower attached to an air diverter selected from a variety of different diverters configured to attach to various flat surfaces or corners in a room. The blower may operate remotely from the diverter when they are connected by an air duct. The system forces dry air between partitioning studs in walls, through flutes typically found in tongue-in-groove flooring, and similarly behind ceilings. The moisture-laden air leaving the wall, floor or ceiling may be captured with a diverter and duct and dried by a dehumidifier before recirculation back through the system or the air may be ducted outside of the water-damaged area. An air heater can also be combined with the blower to enhance the drying process.

11 Claims, 4 Drawing Sheets

RECONFIGURABLE DRYER SYSTEM FOR WATER-DAMAGED FLOORS AND WALLS

BACKGROUND OF THE INVENTION

This invention relates to dryer systems for water-damaged floors and walls. Specifically, it relates to a removable dryer system for temporary application of concentrated drying by air focused specifically on a wet area of a wall, floor or ceiling by attachment uniquely at the area of damage or directed uniquely to the area of damage, adaptable for various attachment configurations.

It is known in the art to have special purpose integrated systems for maintaining floors and walls dry, for example, in cold storage rooms. It is not previously known, however, to have an air-circulating system, removable and transportable, for temporarily drying water-damaged walls and floors of conventional construction such as insulated, studded walls covered by sheet rock and tongue-in-groove floors typically found in residential and commercial construction.

OBJECTIVE OF THE INVENTION

A first objective of the invention is to provide a removable, temporary drying system for focused application on water-damaged areas of general building construction, such as found in residences, schools, or commercial buildings.

A second objective is to provide a single, reconfigurable dryer system versatile in its attachment to corners, flat areas of floors or walls, and under floor cabinet overhangs.

A third objective is to provide a dryer system that operates fully external to a water-damaged wall, floor or ceiling.

A fourth objective is to provide a dryer that recycles air through a dehumidifier.

A fifth objective is to provide a dryer system that ducts moist air outside of a damaged room.

A sixth objective is to provide an adjustable attachment means for extending the full length of the water-damaged area.

A final objective is to provide a dryer system that passes air over a water-damaged surface whose moisture barrier finish has been perforated.

SUMMARY OF THE INVENTION

A floor dryer system is disclosed which is useful for removing water from floors and walls of a typical residential and commercial construction comprising tongue-in-groove flooring and studded, insulated walls covered with painted sheet rock, or the like. The system is temporarily attached specifically to dry a localized, water-damaged area of a floor or a wall, and is removed after the damaged area has been dried.

The focused dryer system which concentrates its drying application to a damaged area comprises a high-volume forced air blower on which may be attached an air duct, typically of 4-inch diameter. On the end of the air duct or attached directly to the blower is an air diverter selected from a variety of provided air diverters for versatile mounting of the system in one of several optional configurations, allowing the system to attach where required and service a specific area. The diverter with an air seal to a wall, floor or ceiling may be adjustable to extend over the length of a water-damaged area.

The system forces dry air between partitioning studs in walls, through flutes typically found in tongue-in-groove flooring, or into ceilings. Moisture-laden air leaving the wall, floor or ceiling may be captured and dried or ducted outside of the room. Either a refrigerant dehumidifier or a desiccant dehumidifier may be used to dry circulating air before reentry into the water-damaged wall, floor or ceiling area. An air heater can be combined with the blower to enhance the drying process. Also, a perforator can be used to pierce a floor or wall moisture-barrier finish through which perforations moisture is then able to escape as air is forced from within. The blower can also be configured to blow air openly over such perforated finish to evaporate escaping moisture, increasing the draw of moisture through the perforations.

DESCRIPTION OF THE PREFERRED EMBODIMENT

Figure 1:
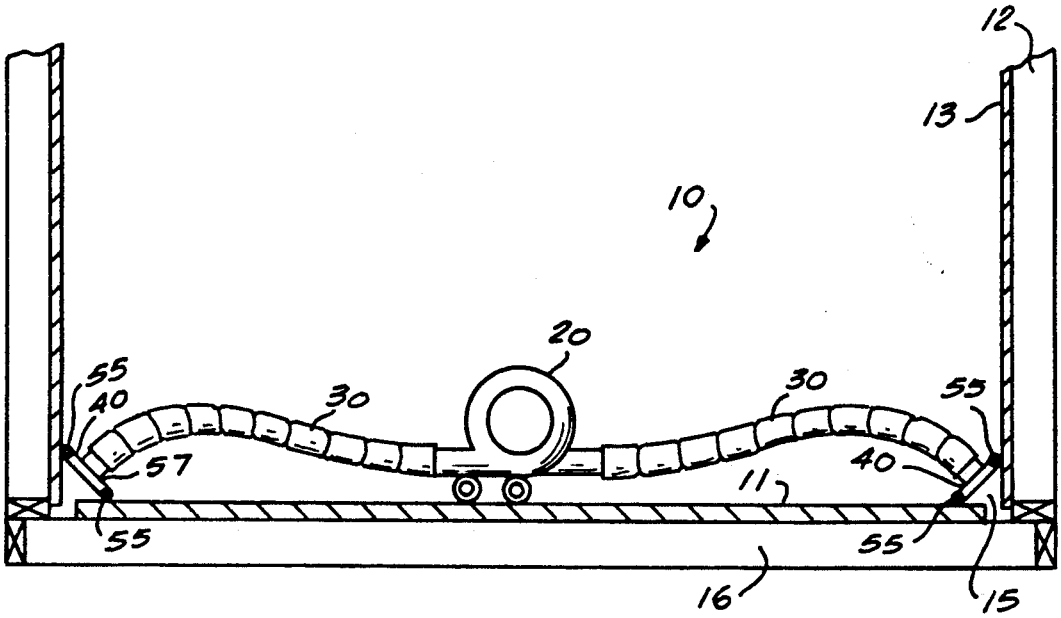
FIG. 1 is a side section view of the dryer system shown attached temporarily to a corner 15 formed by a wall and a floor.

This invention teaches a dryer system for water-damaged floors 11 and walls 12 as shown in FIG. 1. Such damage may have occurred, for example, from flooding, rain leakage, broken pipes, appliance malfunctions, or fire extinguishment. The dryer system 10 comprises a high capacity air blower 20 with a dry air duct 30 for routing blower output to a wall, floor, or similar point of attachment. On the end of the dry air duct is a removable dry air diverter 40 selected from an assortment of removable air diverters which allows the system to be mounted in a variety of configurations.

Figure 2:
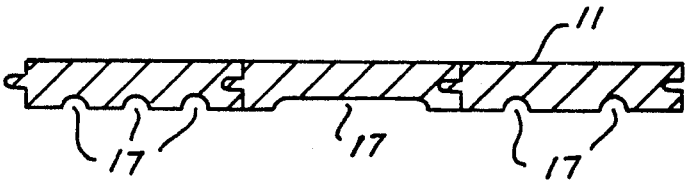
FIG. 2 is a cross section view of a typical floor showing three types of flutes 17 in flooring.
Figure 3:
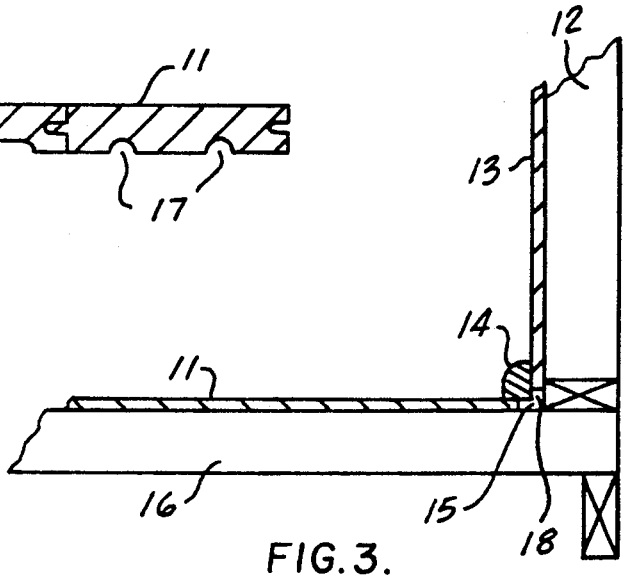
FIG. 3 is a side section view of a room corner in a typical residential construction showing wall board 13, finished flooring 11, insulated studded wall 12, subfloor, 16, and base molding 14.

Walls are typically constructed of studs separating fiberglass insulation. As shown in FIG. 3, floors are generally constructed with an expansion space 18 between ends of the floor 11 and the wall 12. On the undersurface of tongue-in-groove floors 11, shown in FIG. 2, are flutes 17 of any of several possible cross-sectional shapes running the length of the floor 11. A first method of applying the dryer system 10 is to temporarily mount an air diverter 40 to the floor 11 such that the system blower 20 forces dry air through the air duct 30 and air diverter 40 into and through the water-damaged floor through the existing floor flutes 17. If expansion space 18 is closed, a portion of the floor is cut, approximately ⅛-inch to ¼-inch, to restore the expansion space 18 under the area of the corner molding 14. To dry a wall, air is similarly routed between wall studs.

Figure 5:
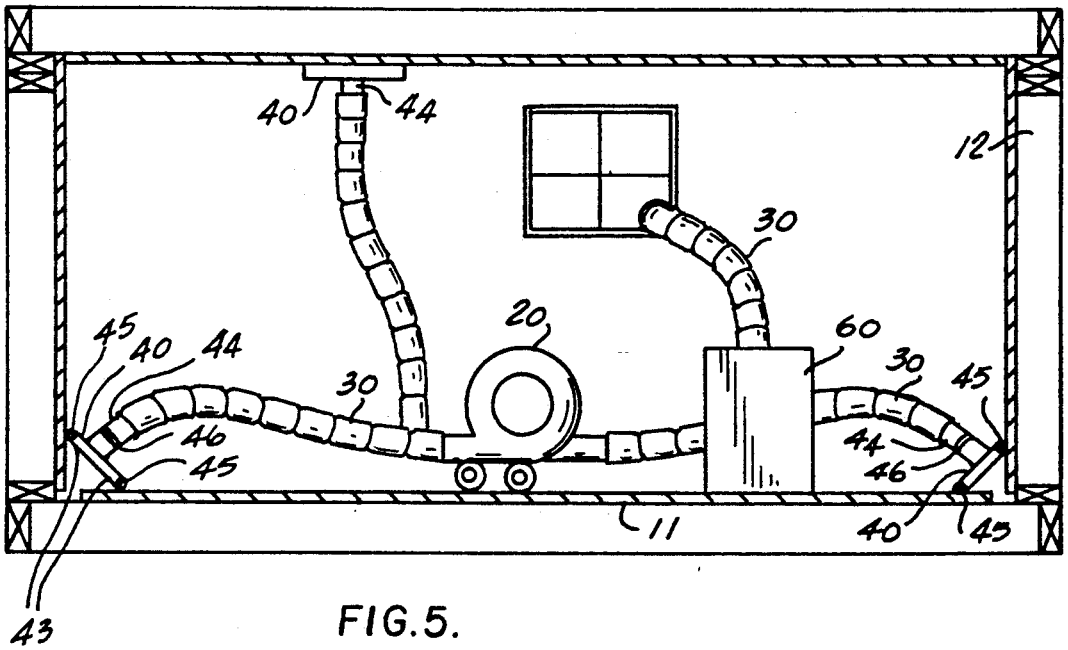
FIG. 5 is a side section view of the dryer system shown with a duct routed outside the water-damaged area and also showing a duct attached to a ceiling.

Air with moisture from the wall, floor or ceiling may be captured by another air diverter 40 at the point the forced air escapes the floor or wall and routed back to the blower 20 through another air duct 30. Between the blower 20 and the air duct 30 returning moisture-ladened air is a dehumidifier 60 for removing moisture from the air before it is recirculated. Alternately, moisture-ladened air returning from a wall, floor, or ceiling may be released into the room, in which case, a dehumidifier 60 takes air generally from the room, dries it, and exhausts the dry air to the system forced air blower 20. The dehumidifier 60 may be a refrigerant dehumidifier which can reduce humidity to below 35%, or it can be a desiccant dehumidifier which can reduce humidity to below 5%. As an alternative, a duct 30 may route moisture laden air outside the room, as shown in FIG. 5. An air heater (not shown) may also be combined with the blower 20 to enhance the drying process.

Each air diverter 40 comprises a duct port 44 for attachment of the air duct, means 46 to secure the air duct 30 to the duct port 44, a contact face 43 for contact with a wall, floor or ceiling, a foam rubber gasket 45 or the like on the contact face 43 for sealing the diverter to the wall, floor or ceiling, and means to temporarily mount the diverter 40 to a wall, floor or ceiling. Gaskets 48 of closed cell foam rubber are preferred because they do not absorb moisture as do open cell rubber foam gaskets. Such means to secure diverter 40 may be screws passing through the diverter 40 into the wall, floor or ceiling.

Figure 10:
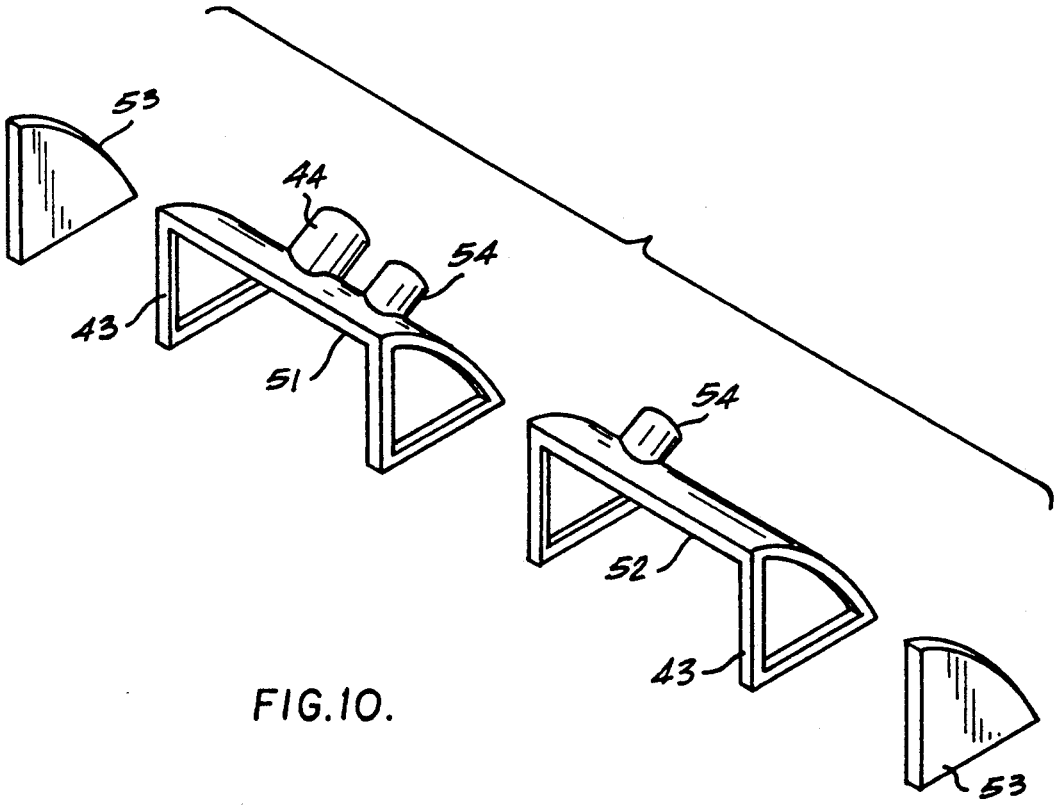
FIG. 10 is a perspective view of an extender, end caps, and a corner air diverter with a gate valve.

A corner air diverter 51, shown in FIG. 10 for attaching a system duct to a corner comprises an angled face matching the wall-floor corner angle. Thus, when air is forced through the duct 30 and through the diverter 51 sealed to the wall-floor corner 15, dry air is forced into the flutes 17. A diverter may also be extendable to cover the length of the damaged floor or wall.

Figure 6:
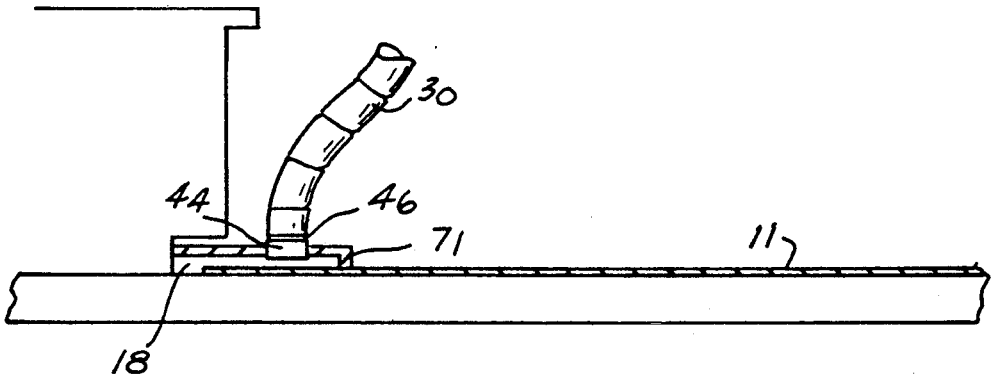
FIG. 6 is a side section view of the dryer system shown temporarily attached to a floor at a corner under a floor cabinet overhang.

As illustrated in FIG. 6, where the finished tongue-in-groove floor terminates at a cabinet with an overhang, a cabinet diverter 71 is provided that attaches to the floor and seals the air diverter to the floor and cabinet, diverting forced air into the expansion space 18 under a cabinet overhang where an angled attachment bracket would not fit. Similar to the corner diverter 51, the diverter comprises a face horizontal with the floor and vertical with the cabinet, but small to fit under the cabinet overhang.

Figure 8A:
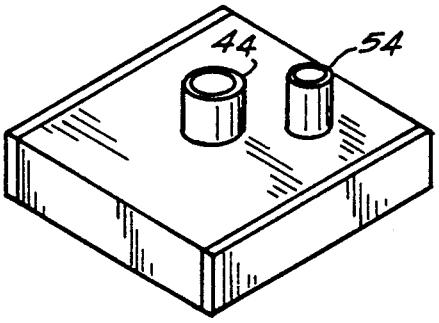
FIG. 8*a* and FIG. 8*b* are top and bottom perspective views, respectively, of a flat diverter.
Figure 8B:
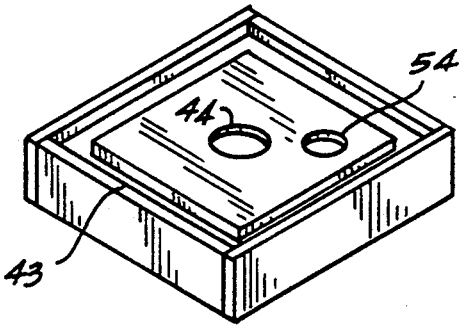
Figure 9:
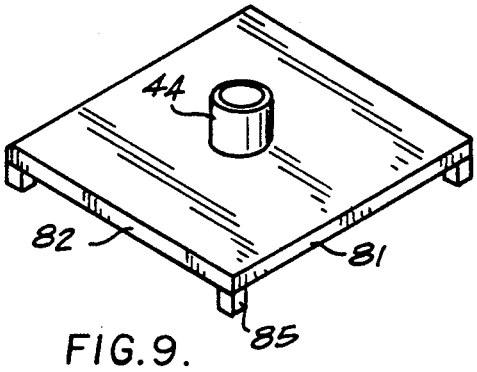
FIG. 9 is a top perspective view of a flat diverter on supports for open passage of air out of the diverter.
Figure 11:
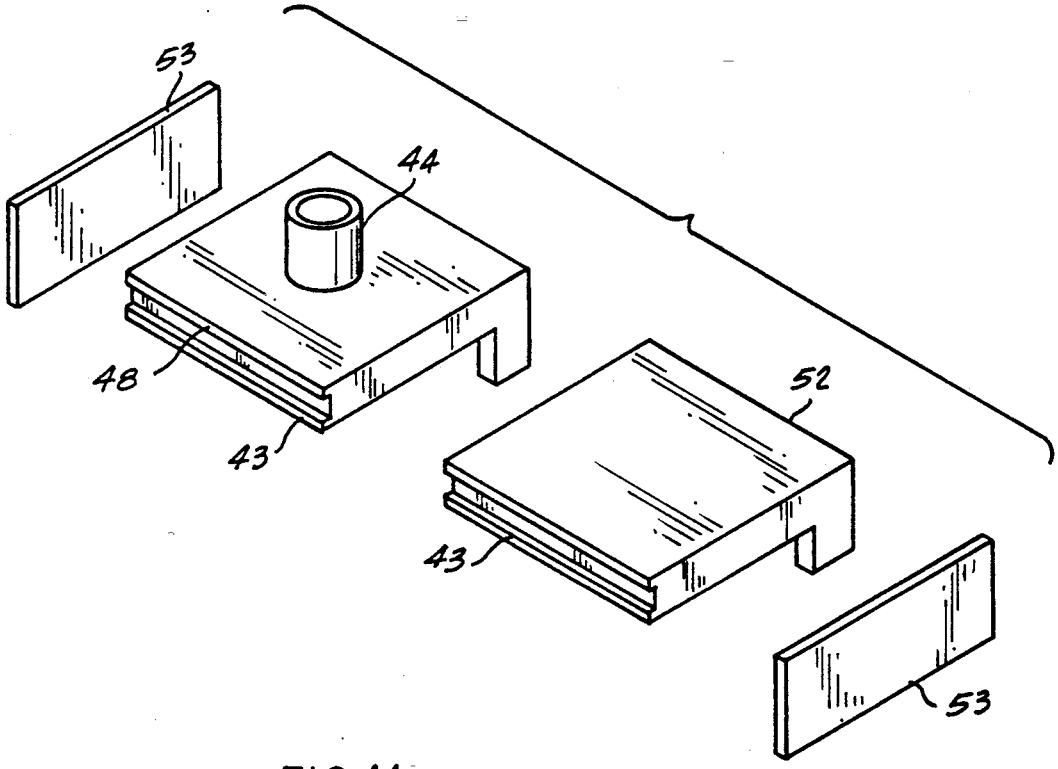
FIG. 11 is a perspective view of a cabinet air diverter with extender and end caps.

As shown in FIG. 8 and FIG. 9, an extendable diverter, shown in FIG. 10 as a corner diverter 51 and in FIG. 11 as a cabinet diverter 71, has open sides so that when a plurality of diverters 40, for example, corner diverters 51 or extenders 52 (diverter without duct port 44) are aligned in adjacency to form an extended diverter alignment, air from the system forced air blower passes to all of the diverters 40 or extenders 52. A side cap 53 at each end of the alignment closes an extended diverter alignment. Sealing means, such as adhesive duct tape, prevents air from escaping between adjacent diverters or extenders. Diverters 51 and extenders 52 may also have a gate valve 54 to relieve back pressure or to provide forced air communication between two diverters 51 through ducts 30. Similar diverter extension may be employed for other diverter configurations.

Figure 4:
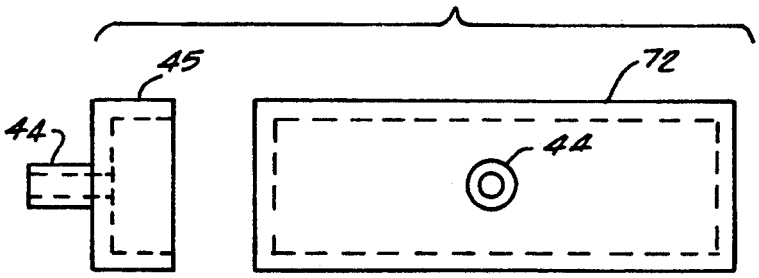
FIG. 4 is a side and top view of a dryer system configured for temporary attachment to a floor.
Figure 7:
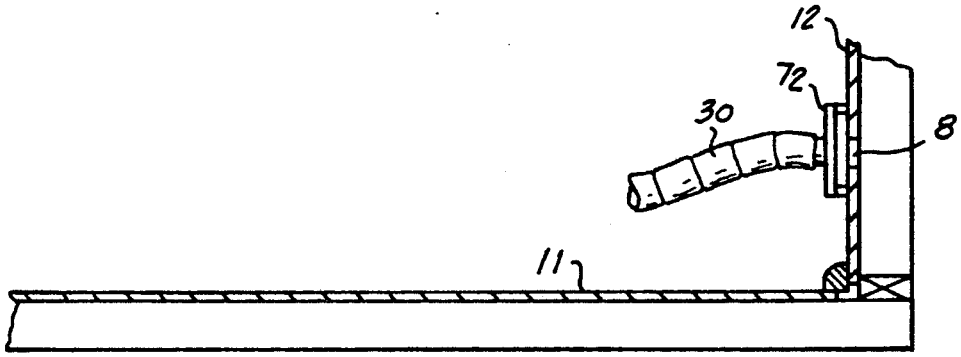
FIG. 7 is a side section view of a dryer system duct attached to a wall.

As a further alternative, a flat diverter 72, shown in FIG. 4 and in FIG. 8, may be attached to a floor or to a wall, as shown in FIG. 7, or to a similar flat surface. To attach to a wall or a ceiling, a hole 8 is first cut in the wall and is then repaired after the drying process. To attach to a floor, typically one or more pieces of flooring is removed from a central area of the floor. This can provide the means of accessing the expansion space covered by molding in difficult-to-attach locations. The flooring is replaced after the drying process is complete.

As another alternative, the dryer system duct 30 may also direct air openly over a water-damaged surface using an open diverter 81. Open diverter 81 additionally comprises a diverter face 82, without gasket, mounted parallel to a floor or wall on supports 85 for supporting the air diverter off of the floor or wall. Use of this open diverter is typically in combination with a perforator for penetrating wall, floor or ceiling moisture-barrier finishes, such as paint and varnishes, for example, by a wall paper perforator, so that air forced over the wall, floor or ceiling surface will vaporize moisture as it is drawn to the surface.

Having described the invention, what is claimed is:

1. A reconfigurable and transportable temporary dryer system with adaptable attachment to a water-damaged floor or wall for concentrated application in the removal of moisture from damaged building floors, ceilings, and walls, comprising an air blower directed to force air at increased pressure from the air blower to a water-damaged area, an air diverter in forced air communication with the air blower for temporarily mounting the dryer system to a water-damaged floor, ceiling, or wall, the air diverter further comprising a diverter port for attachment of the air blower, and a contact face having sealing means comprising a gasket for substantially providing an air tight seal to a corner or to a flat surface of said water-damaged wall, floor or ceiling of a building, and an air duct connecting the diverter port to the air blower.

2. A dryer system as in claim 1 further comprising a dehumidifier connected to the air blower such that the dehumidifier dries air before the air enters the air blower.

3. A dryer system as in claim 2 further comprising a second air diverter in fluid communication with the dehumidifier and mountable at a location at a wall, floor or ceiling where forced air from the system escapes the wall, floor or ceiling for routing return air to the dehumidifer.

4. A dryer system as in claim 1 further comprising a second air diverter mounted at a location at a wall, floor or ceiling where forced air escapes the wall, floor or ceiling, when the air has been forced into the wall, floor or ceiling under increased pressure from the system air blower, and a return air duct which routes moisture-laden air away from a water-damaged area.

5. A dryer system as in claim 1 wherein the diverter contact face comprises a wall face for mounting to a wall and a floor face for mounting to a floor where the wall face and the floor face form a right angle to match a wall-floor corner.

6. A dryer system as in claim 5 wherein the diverter wall contact face is limited in vertical extent such that it fits under a cabinet overhang.

7. The method of drying a water-damaged floor area which comprises the following steps:

a. removing any molding that may be found in a wall-floor corner where an air diverter will be attached;

b. removably mounting an air diverter to the wall-floor corner over a floor expansion space in the wall-floor corner for establishing forced air communication with flutes in the undersurface of wood flooring;

c. forcing dry air into the air diverter and through flutes in the flooring.

8. The method of claim 7 further comprising, before the second step (b), the step of cutting a small section, nominally $\frac{1}{8}$-inch to $\frac{1}{4}$-inch, from the end of a floor at the wall-floor corner over the extent of the water-damaged area.

9. The method of drying a water-damaged area of a building wall, floor, or ceiling, which comprises the following steps:

a. removing a portion of a structure thereby forming a hole to an inner structure area of flutes in an undersurface of a wood floor or areas behind a wall of a ceiling surface, for establishing forced air communication with said inner structure area;

b. removably mounting an air diverter over the hole in the structure;

c. forcing dry air into the air diverter and the structure.

10. The method in claim 7 or 9 further comprising before the last step the step of perforating a surface finish of a floor or wall, which finish functions as a moisture barrier, thus allowing moisture to escape through the perforations as air is forced into the wall, floor or ceiling.

11. The dryer system as in claim 1 wherein the diverter further comprises a diverter having open sides, one or more extenders with open sides in forced air communication with the diverter, aligned in adjacency with each other and with the diverter to form an extended diverter alignment with forced air passing from the air blower to all extenders and the diverter, which extenders also each comprise a contact face configured to provide an air seal to a corner or to a flat surface of a wall, floor or ceiling, thereby functionally extending the diverter, adjustable in width by the number of extenders incorporated into the alignment, and a side cap on each end of the extended diverter alignment to close the alignment.

* * * * *